US006138356A

United States Patent [19]

Hertelendy

[11] Patent Number: 6,138,356

[45] Date of Patent: Oct. 31, 2000

[54] METHOD OF STABILIZING A NECKLACE

[76] Inventor: Anita W. Hertelendy, 3364 Newburg Rd., Louisville, Ky. 40218

[21] Appl. No.: 08/905,533

[22] Filed: Aug. 4, 1997

[51] Int. Cl.[7] ..... B21F 43/00

[52] U.S. Cl. ..... 29/896.41; 63/4

[58] Field of Search ..... 29/896.41, 896.4, 29/896.411, 896.42; 63/3.1, 4

[56] References Cited

U.S. PATENT DOCUMENTS 3,208,238 9/1965 Spitzer ..... 63/3.1

4,527,316 7/1985 Murphy ..... 63/4

5,586,374 12/1996 Nishida ..... 63/3.1

*Primary Examiner*—P. W. Echols

*Attorney, Agent, or Firm*—John R. Benefiel

[57] ABSTRACT

A stabilizer accessory for necklaces to keep the necklace from twisting about the wearer's neck. The stabilizer is an elongate approximately oval-shaped metal loop which is connected as by clasps to the necklace ends, and rests on the nape of the neck of the wearer. The presence of the stabilizer causes the necklace to resist twisting of the necklace, stabilizing the necklace in its proper position.

1 Claim, 1 Drawing Sheet

METHOD OF STABILIZING A NECKLACE

BACKGROUND OF THE INVENTION

This invention concerns chain jewelry and more particularly necklaces having a pendant or other item supported by an ornamental chain worn around the neck. There is a tendency for the chain to become twisted as the wearer moves about during even casual activity as the chain links do not rotate freely with respect to each other, as in the case of a beaded necklace, which in turn causes the pendant to become reversed or turned. The wearer must thus frequently check and adjust the position of the necklace.

It is the object of the present invention to provide a necklace accessory to inhibit the twisting of a chain necklace when being worn.

SUMMARY OF THE INVENTION

The above object is achieved by use of a stabilizer comprising an elongated metal loop attached at the necklace chain clasp ends, the loop shaped as an elongated roughly oval shape, much longer than the usual fine jewelry chain link. This shape and size loop has been found to very effectively inhibit the twisting of the chain necklace induced by the wearer's movements. The loop is held against the wearer's skin by the weight of the necklace and sufficiently large as to minimize the tendency for the connected necklace to become twisted.

The accessory loop is adapted to be attached to existing chain necklaces or added to the necklace as an integral part by adding clasps to small connector eyes fixedly attached at either end of the stabilizer loop.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
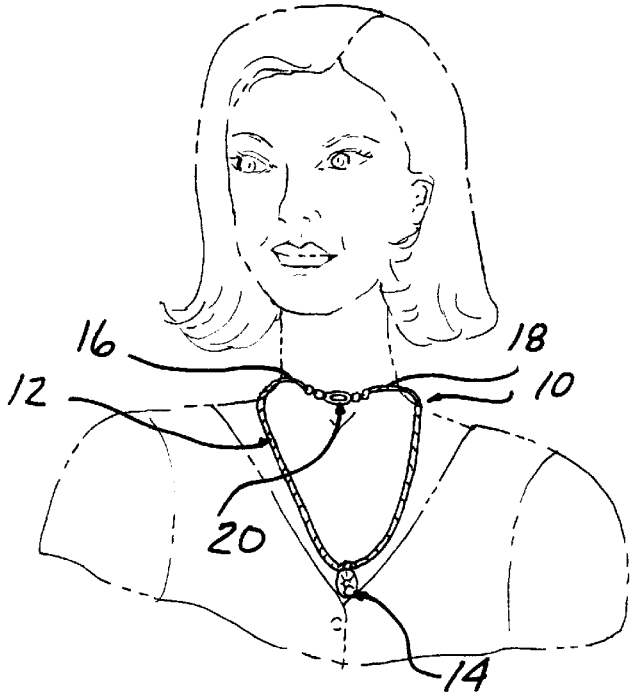
FIG. 1 is a perspective view of a necklace having a stabilizer according to the present invention.

FIG. 1 shows a chain necklace 10 being worn around the neck of a wearer. The chain necklace is of conventional design, including a jewelry chain 12 comprised of a series of connected links, including a necklace section draped across the front of the wearer, which section supports a pendant item 14.

The connected ends 16, 18 pass around the nape of the wearer's neck and are joined by a stabilizer 20 according to the present invention.

Figure 2:
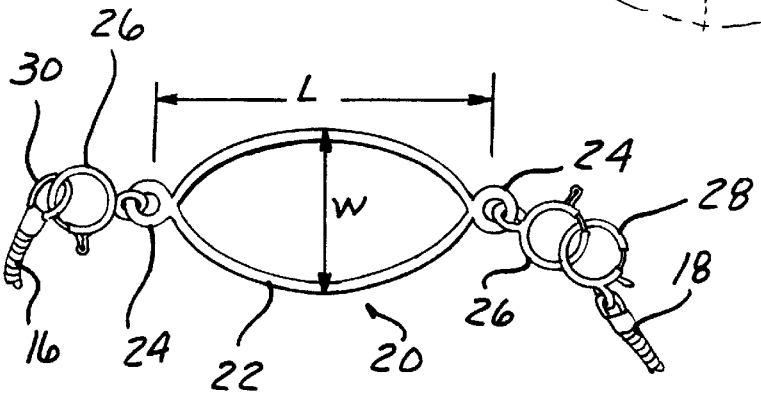
FIG. 2 is an enlarged plan view of the stabilizer according to the invention with fragmentary adjacent portions of the necklace.

As best seen in FIG. 2, the necklace stabilizer 20 comprises an elongate roughly oval shape metal loop 22 with an attachment eye 24 integrally fixed to each somewhat pointed end.

The width W is approximately one-half inch and length L is on the order of one inch, which is substantially enlarged over the chain links, and with the loop possibly varying in width and length somewhat while still functioning to create an antitwist action when resting on the wearer's skin at the nape of the neck.

An approximate range of widths W and lengths L varying by plus or minus one-quarter inch from the sizes mentioned will achieve the desired result.

At the same time, the necklace 10 so equipped is still quite comfortable to wear, as no feeling of increased weight or pressure is experienced by the wearer.

The stabilizer 20 may be provided with a pair of spring-operated clasps 26, each received over a respective eye 24 which allow attachment to the respective necklace chain ends 16, 18, one clasp receiving the necklace clasp 28 and the other the loop end 30.

Figure 3:
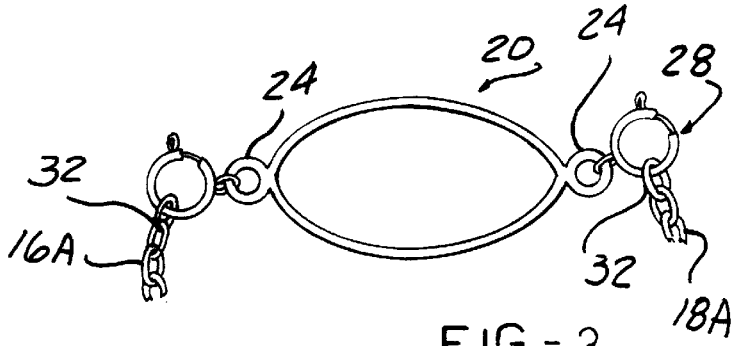
FIG. 3 is an enlarged plan view of the necklace stabilizer shown with a different installation onto the necklace ends.

FIG. 3 shows an alternate attachment where the clasps 26 directly receive chain loops 32 of the respective ends 16A, 18A.

Figure 4:
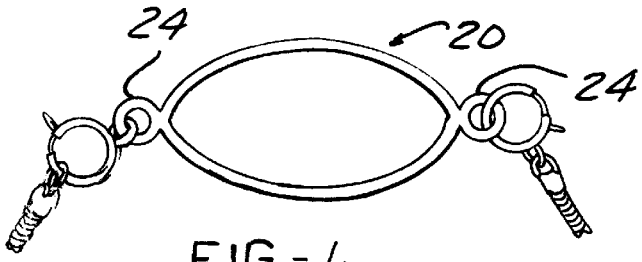
FIG. 4 is another different enlarged plan view of the necklace stabilizer shown with a different installation onto the necklace ends.

FIG. 4 shows an alternate attachment where the necklace clasp 28 is received over an eye 24 and only one stabilizer clasp 26 is needed, used to attach to the chain loop 30.

The stabilizer 20 is preferably constructed of a precious metal or plated with a precious metal such as silver or gold to be compatible with fine necklaces and to be able to be worn in contact with the wearer's skin for extended periods.

I claim:

1. A method of stabilizing a chain necklace made of chain links not freely rotatable with respect to each other to inhibit twisting of the necklace on a wearer's neck, comprising the step of installing an enlarged elongated loop substantially larger than said chain links and having opposite ends to said necklace chain, with each end of said necklace chain fixedly attached at a respective end of said loop, said loop located to normally rest on the skin of the nape of the neck of a wearer, thereby reducing the tendency for twisting of said necklace chain to stabilize said necklace position on the wearer's neck.

* * * * *